United States Patent [19]

Hendrischk

[11] Patent Number: 4,579,471

[45] Date of Patent: Apr. 1, 1986

[54] TRANSPORTING SHEET STOCK IN PRINTERS

[75] Inventor: Wolfgang Hendrischk, Neu-Ulm, Fed. Rep. of Germany

[73] Assignee: Mannesmann Aktiengesellschaft, Duesseldorf, Fed. Rep. of Germany

[21] Appl. No.: 517,253

[22] Filed: Jul. 25, 1983

[30] Foreign Application Priority Data

Jul. 29, 1982 [EP] European Pat. Off. ..... 82730102.9

[51] Int. Cl.[4] ..... B41J 11/00

[52] U.S. Cl. ..... 400/605; 400/641; 271/206

[58] Field of Search ..... 400/584, 638, 639, 639.1, 400/618, 600.2, 600.3, 605, 613.1, 631, 637.1, 647.1, 645, 645.4; 271/204, 206, 268

[56] References Cited

U.S. PATENT DOCUMENTS

| | | | |
|---|---|---|---|
| 1,208,757 | 12/1916 | Dennis | 400/584 X |
| 1,395,458 | 11/1921 | Stickney | 400/584 |
| 1,994,647 | 3/1935 | Helmond | 400/639.1 X |
| 2,328,146 | 8/1943 | Hill et al. | 400/631 |
| 3,421,612 | 1/1969 | Pitt | 400/584 |
| 3,519,117 | 7/1970 | Smith | 400/636.2 X |
| 3,753,483 | 8/1973 | Lundquist et al. | 400/605 X |
| 4,164,376 | 8/1979 | Yarp | 400/618 X |

FOREIGN PATENT DOCUMENTS

| | | | |
|---|---|---|---|
| 1922027 | 11/1970 | Fed. Rep. of Germany | 400/584 |
| 0018281 | 1/1982 | Japan | 400/605 |
| 0018282 | 1/1982 | Japan | 400/605 |
| 0173435 | 11/1934 | Switzerland | 400/600.2 |
| 0202177 | 12/1938 | Switzerland | 400/600.3 |
| 0264316 | 10/1949 | Switzerland | 400/600.2 |
| 0557067 | 12/1974 | Switzerland | 400/584 |

OTHER PUBLICATIONS

IBM Tech. Disc. Bulletin, "Single Sheet Insertion", Garrison et al., vol. 23, No. 9, Feb. 1981, pp. 3965–3966.

*Primary Examiner*—William Pieprz
*Assistant Examiner*—James R. McDaniel
*Attorney, Agent, or Firm*—Ralf H. Siegemund

[57] ABSTRACT

The printer is constructed for multiple merging feed paths sharing a pivotable brake and by means of adjustably mounted different sets of rolls different combinations in the disposition of the rolls and the brake vis-à-vis the platen drum different modes of transportation are attainable.

10 Claims, 6 Drawing Figures

1
1a
1b
2
3
3a
3b
4
4a
4b
5
7
8
8a
8b
9
9a
9b
10
10a
11
11a
11b
12
12a
12b
13
14
15
15a
15b
16
16a
16b
17
18
19
20
20a
21
21a
22
22a
23
23a
24
25
F

TRANSPORTING SHEET STOCK IN PRINTERS

BACKGROUND OF THE INVENTION

The present invention relates to the transportation of sheet stock in printers, preferably in matrix printers with separate tangential feeding of endless sheet or web material and of individual sheets towards the printing platen under utilization of pressure rolls which hold the respective sheet stock against the printing platen.

Printers of the type to which the invention pertains must be amenable to accommodate different types of material to be printed on, whereby various sheet material may be differently wide. The feeding of individual sheets and of one or more endless webs hold different problems. Moreover, it is desirable to provide for some automatic changeover from one kind of stock to the other and it is also necessary to avoid concurrent feeding of endless sheet stock and individual pieces of print material.

The German printed patent application No. B2717758 describes a typewriter in which individual sheets, as well as endless sheet stock is fed from one and the same side into the machine, and an automatic changeover is accommodated through the use of a channel in which the endless sheet stock is maintained in a waiting and stopping position under utilization of its own drive. At the end of the channel, a switch is provided which extends over the entire length of the drum shaped printing platen and which blocks either the adjoining path for individual sheets or the channel exit for the endless sheet or web. The switch is operated therefore, whenever a changeover from one kind of print stock to the other is desirable. The changeover, of course, is carried out through appropriate control structure. The problem exists however that printers, particularly matrix printers provide specific situations which render feeding of the different material of sheet stock from the same side impractical or even impossible.

The European Pat. No. B19676 discloses a transport device for print sheet stock in matrix printers using different kinds of stock, such as continuous strips, individual cards, document paper of different width and the like, and different transport mechanisms are provided which are associated with a common printer proper. However, this particular solution is suitable only for internal sheet stock wound on an internal spool and for external print material such as checks or the like.

DESCRIPTION OF THE INVENTION

It is an object of the present invention to provide a new and improved feeding structure in printers which can accommodate a variety of material to be printed on such as individual sheets and one or more parallel endless sheets under conditions which permit a simple and rapid change from one type of sheet stock to the other.

In accordance with the preferred embodiment of the present invention, it is suggested to provide for a plurality of different feed paths towards a platen drum and two sets of pressure rolls are arranged in azimuthal spacing along the periphery of the printing platen for engagement and cooperation with individual sheets in a friction drive mode and whereby a particular brake operates also by frictional engagement and constitutes a part of the feeding structure. First and second feed paths are provided, the first one for single sheet feeding, the second one for endless sheet feeding either in the frictional mode or for cooperation with a sprocket drive downstream.

In a first mode or operating state, all of the rolls as well as the brake mentioned above are urged towards the periphery of the platen drum; in a second mode or operating state, all of these components are receded from the platen drum whereby particularly the brake projects into the second path for endless sheet feeding; and in a third mode only the rolls are receded from the platen drum. The brake thus provides a double function as it is used for individual sheet feeding as well as for feeding endless sheets and it switches positions with respect to participation in one or the other of the two feeder paths. The first operating mode or state establishes friction drive conditions for feeding to take place through either path; the second operating mode or state is provided for cooperation with the downstream sprocket drive; the third operating mode or state is provided for threading a new endless sheet into the printer.

Concerning particular features of the invention and here the particular construction of the individual feed paths, the first one is provided for a manual feeding on the upper side of the printer and is constituted by a narrowing duct leading tangentially towards the printing platen whereby in the end portion of that duct the platen itself functions as a boundary for that channel. The opposite wall in this range is actually provided through the brake. The brake is preferably a movably mounted and resiliently supported guide sheet which functions also as a brake. This guide sheet is actually constructed to have a braking function on opposite sides because the brake preferably arranged at a location where the first and second feed patterns merge.

In furtherance of the invention, it is suggested that the set of pressure rolls arranged in direction downstream from the first one is mounted for easy rotation in a shaft whereby, however, the shaft inself will rotate at a lower degree of ease. In connection herewith it is important that the relationship of friction between the sheet stock, the pressure rolls and the journaling of the rolls on one hand as well as of the shaft carrying the rolls on the other hand are selected so that the transported sheet is held taut.

The different transport modes accommodate different sheet stock in different feed channels and the operative relation is established basically through a selection of relative disposition of the two sets of pressure rolls vis-a-vis the platen and by a proper adjustment of the guide sheet having the aforementioned double brake function in both feed paths, but for different adjustment. For this purpose, lever and pivot mounts are suggested for these elements and they are arranged to be actuated through a common adjusting drive which is manually operated, for example, in establishing a plurality of different adjusting positions; each of the positions can be held through a locking mechanism and in each of these adjusting positions a particular combination is selected in the pivot arrangement of the pressure rolls and of the brake sheet mentioned above. This permits a high degree of versatility as far as feeding and utilization of different types of stock is concerned. The adjustment is a simple one and one uses a selection between top and rear feeding.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figures 1, 1A:
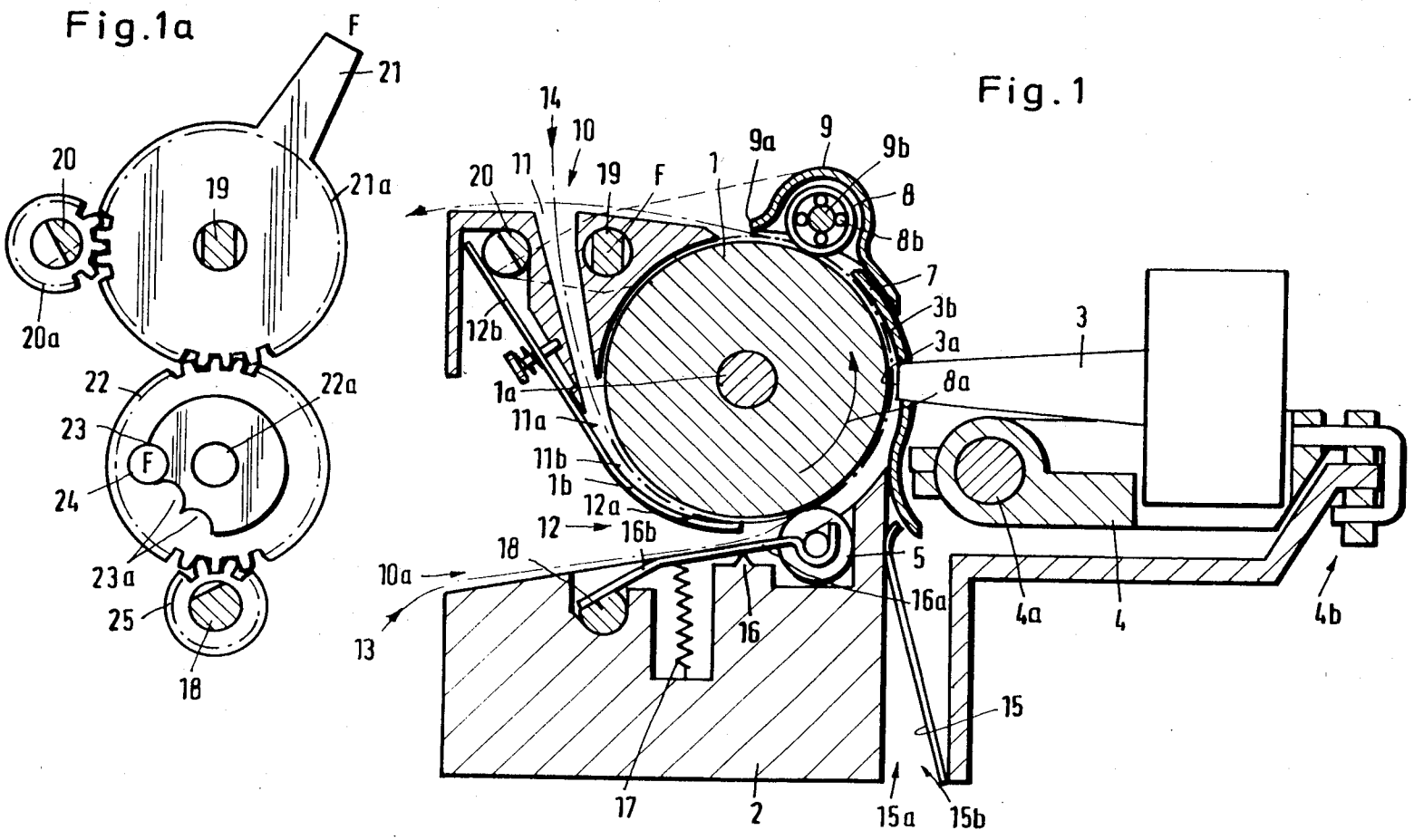
FIG. 1 is a cross section through a portion of a matrix printer incorporating the features in accordance with the preferred embodiment of the present for practicing the best mode thereof.
FIG. 1*a* is a side view of a portion of the structure shown in FIG. 1, showing particularly the changeover mechanism from one type of sheet stock to another type, the adjustment being made for friction transport of single sheets and endless webs.

Proceeding now to the detailed description of the drawings, reference is made particularly to FIG. 1, but also to the other figures illustrating a printing platen 1 of drum shaped configuration and being rotatably mounted and journaled in a frame structure 2. The platen cooperates with a matrix printhead 3 which is mounted on a carriage 4 which in turn rides on a rod 4*a* extending parallel to the axis 1*a* of the printing platen. Reference numeral 4*b* refers to a guide structure running parallel to the rail rod 4*a*.

A plurality of pressure rolls 5 are distributed along the axis 1*a* of the platen 1 and these rolls are resiliently mounted to urge sheet stock such as paper against the printing platen for frictional engagement with the surface thereof. At some point along the width of the paper, a sensor (not illustrated) monitors the presence or absence of paper and generates an optical and/or acoustical signal, for example in those instances in which the machine has run out of sheet stock to be printed on.

A somewhat curved guide structure 7 is mounted on the carriage 4 for engagement with the paper guiding it towards rolls 8*a*. Somewhat above the area being printed on is provided another set of roll 8 which are also distributed along the axis 1*a* of the printing platen 1 and the respective rolls are arranged in a common frame 9. The arrangement is such that the rolls 8 are journaled on and along a shaft 9*b* for easy rotation. The rolls are urged against the printing platen by the frame 9 which is in addition provided with a tear edge 9*a* for separating individual sheets from web material. A sensor is arranged next to the frame 9 and operating, for example in an optical electronic fashion in order to monitor absence and presence of paper at that point, i.e., slightly downstream from the frame 9. This monitoring arrangement is not shown, but it can readily be seen that plural different sensors can be provided wherever needed; the monitoring of paper in a printer is well known per se and does not constitute a part of the invention.

The printer and here particularly the frame 2, is provided with a first feeder channel 11 for feeding individual sheets towards the platen. These sheets may be fed manually into this duct or channel or a sheet-singling device may provide for the requisite automatic feeding. A brake structure 12 is provided in the region where the channel 11 merges with the immediate periphery of the printing platen. The path for these individual sheets is denoted generally by the dash dot line 14. The brake 12 is a curved sheet and constitutes one wall of the feed channel 11*a* adjacent the platen 1 which completes the feed channel downstream from channel structure 11.

The individual sheets entering the channel 11 along the path 14 are urged by means of the brake 12 against the platen 1. The duct or channel 11 narrows in the direction 8*a* of advance to the narrow chute 11*a*. 11*b* refers to a length dimension along which actually platen 1 constitutes 1 wall of the chute or channel 11*a*. The function of brake 12 is primarily for slowing the entering sheet stock, an additional function will be described below. The brake sheet 12 is mounted for pivoting as will also be described below. Another sensor, not shown, may be provided to monitor absence or presence of sheet stock in the duct to channel 11.

The rear side 10*a* of the frame 2 is of open construction and a lower, oblique platform establishes a second feed path 13. The two feed paths, 13 and 14, are azimuthally displaced with regard to the periphery of the drum. The two are paths 13 and 14 merge in the range of the rolls 5. However, these paths should receive sheet stock only in a mutually exclusive fashion. Reference numeral 15*a* refers to a third feeder path in which individual sheets are fed into the printer from below, past a brake 15 at the underside 15*b* of the frame 2. Therefore, it can be seen that individual sheets can actually be fed from the upper side 10 the rear side 10*a* or the under side 15*b;* but rear side 10*a* is provided primarily for feeding endless stock into the printer.

The transport device provides for a plurality of the following functions: (1) a friction drive for endless sheet stock; (2) a friction drive for manually fed individual sheets; (3) a friction drive for automatic feeding of individual sheets; and (4) a traction drive for endless sheet stock (see traction drive 26 in FIG. 2).

In order to provide for these functions, the pressure rolls of the set 5 are respectively journaled in a set of levers 16 each having a first lever arm 16*a* for rotatably mounting the respective roll 5 and a second lever arm 16*b* extends rearwardly from the lever 16*a* and functions as a control lever portion which in resting position is pulled by tension spring 17 against a flat cam portion of a shaft 18 for the control of this lower set of pressure rolls 5. For mounting and pivoting the upper set of pressure rolls 8 a twin cam-shaft 19 is journaled either in the frame 2 or in the frame 9. Twin cam is to mean two flat cam surface portions as illustrated. A third cam-shaft 20 engages a rear end portion 12*b* of brake 12 and controls the brake 12 particularly for manual paper feeding.

The single cam surface shaft 18, the double surface cam-shaft 19 and the single surface cam-shaft 20 are all actuated in unison by means of a hand lever 21 arranged on the outside and on the broad side of the printer. The lever 21 is visible in the FIGS. 1*a*, 2*a* and 3*a*. Lever 21 carries a gear portion 21*a*. The shaft 20 carries a gear 20*a* which meshes with gear 21*a*. An intermediate gear 22 is provided on an intermediate shaft 22*a*, and the gear 22 meshes also with the gear 21*a*. A disc 23 is mounted on the gear 22 which disc 23 is provided along its peripheral with several recesses or notches 23*a*. An index pin 24 can rest in any of these notches 23*a* thereby locking the disc and the gear 22 in particular positions.

However, in the case of manual operation of lever 21 index pin 24 can resiliently yield to drop, for example into the next notch 23*a*. The hand lever 21 drives therefore the gear 21*a*, the gear 22 and the gears 20*a* and 25 for respectively driving the shafts 18 and 20. Lever 21 drives cam-shaft 19 directly. The flat cam surface portions of the several shafts have particularly phases and orientation in relation to each other.

FIG. 1*a* illustrates a particular operating position being, for example, externally indicated by a suitable marking F. This operating state F is characterized by pivot positions of the set of rolls 5 and 8 into respective engagement with the platen drum 1 (separated only by sheet stock); brake 12 is positioned in a channel or chute 11*a*-narrowing disposition. This position of the lever 21 is provided for feeding endless sheet stock along the track 13 under frictional operation. In the same position of lever 21, individual sheets can be automatically fed along the path 14 or individual sheets can be manually fed along the path 14, i.e., into the channel 11. Of course, feeding of sheet stock along the path 13 is mutually exclusive with regard to the feeding along path 14.

Figures 2, 2A:
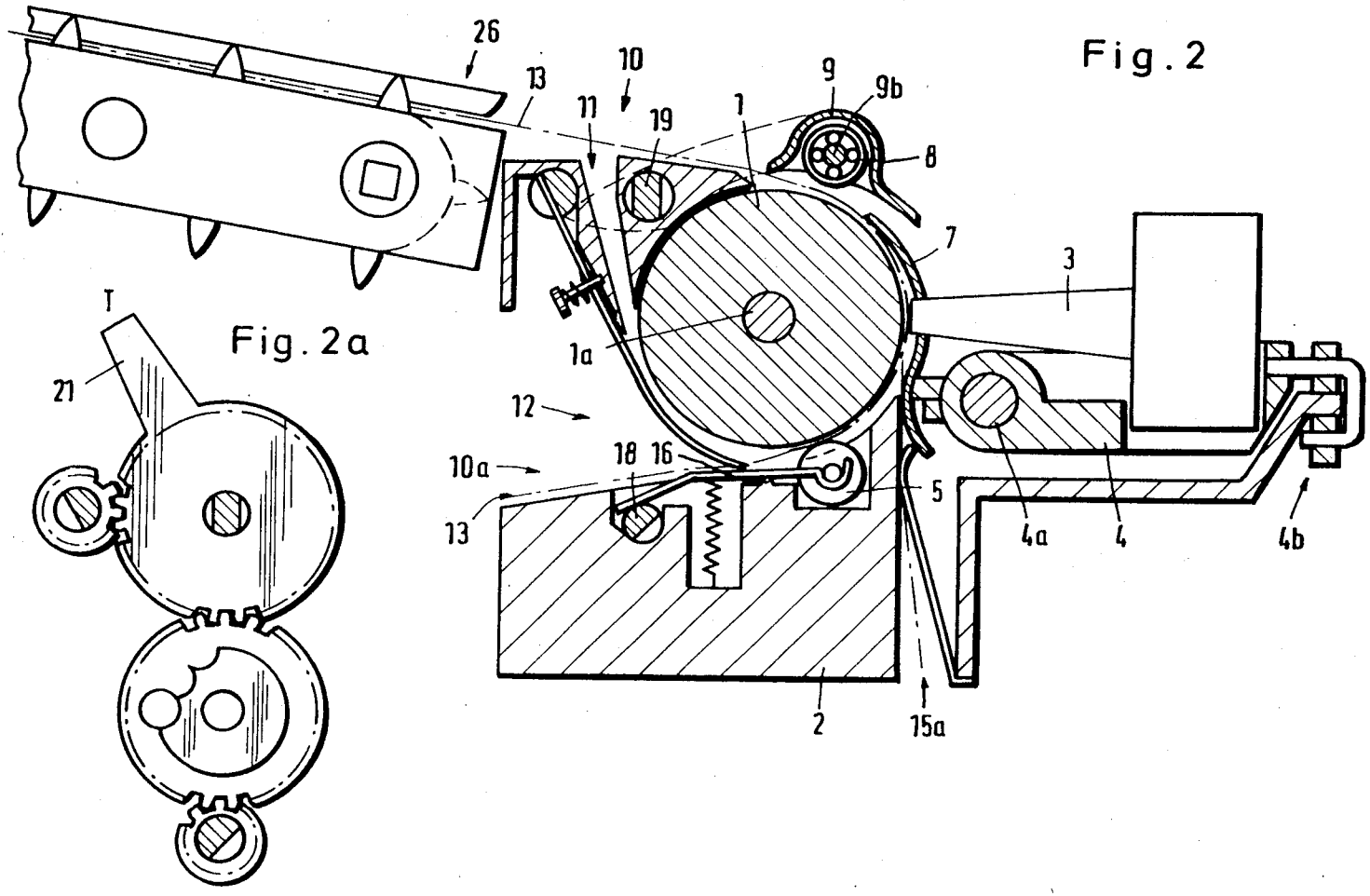
FIG. 2 is a cross-section through the matrix printer adjusted for sprocket type transport.
FIG. 2*a* is a side view of the adjusting structure associated with the adjustment of the device as shown in FIG. 2.

In the case of a larger diameter of the platen 1, the tractor 26 provides for a shorter transport path as compared with the transport path into looping position around the periphery of the transport and platen drum. The tear edge 9*a* is used under such circumstances. FIG. 2*a* illustrates a second alternative disposition of the lever 21 indexing, for example, with a marking T. Under this condition, it is assumed that the traction device 26 with sprocket wheel type transport structure is placed down stream of feed path 13 and engages edge perforations of an endless web being either an endless sheet as such or losely connected individual sheets moving along the path 13.

The pressure rolls 5 and 8 have been pivoted away from the printing platen 1 so that any transport is not provided through frictional engagement or only minimally so, the movement of the sheet stock in downstream direction is provided by the sprocket device 26. The brake 12 is also moved off engagement with the platen 1 and holds taut the sheet stock fed along the path 13 on the rear side 10*a* of the printer. This is the second operating state of the system, it may be of advantage in this case to select the diameter of the rotationally driven printing platen 1, such that the speed ratio of the platen in relation to the sprocket speed is slightly lower the sheet stock is held taut through some friction.

Figure 3:
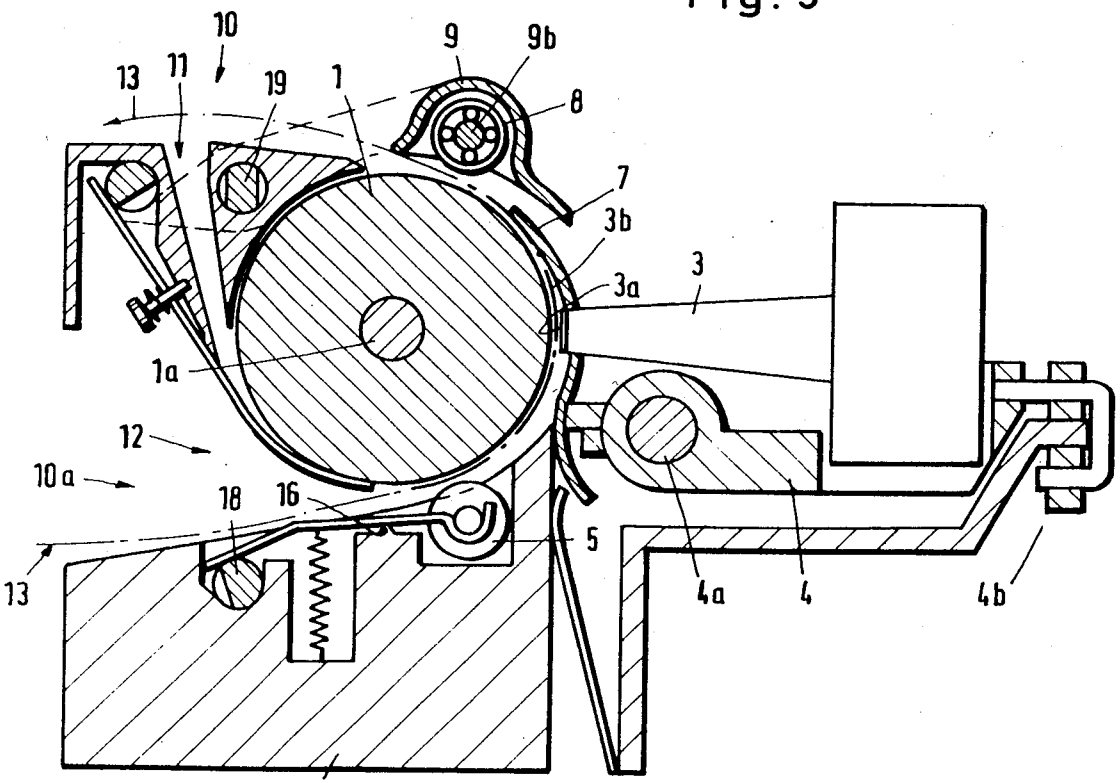
FIG. 3 illustrates the same printer, adjusted for manually threading and endless web into the transport structure.
Figure 3A:
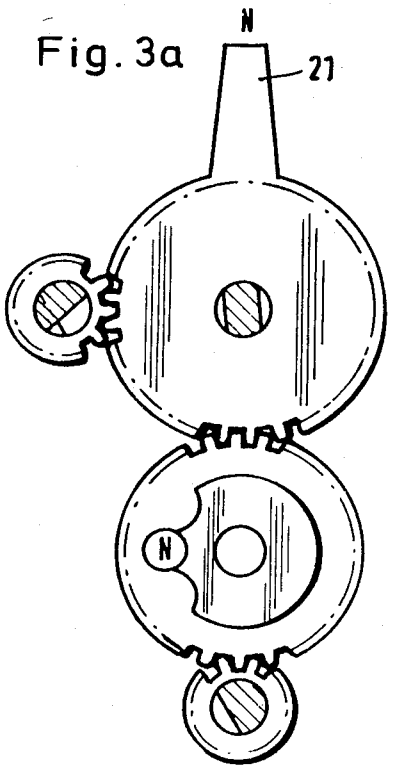
FIG. 3*a* is a side view of the adjusting mechanism for obtaining the disposition as shown in FIG. 3.

FIG. 3*a* illustrates the lever 21 in the middle position identified by N and denotes an operating state of the machine in which sheet stock 3*b* can be inserted under utilization, for example, of color ribbon 3*a*. This position is used for feeding initially the front portion of a web into and through the printer until, for example, engaging the sprockets in device 26. In the disposition N the lower set of rolls 5 and the upper set of rolls 8 are also retracted from the platen roller 1, but the brake 12 is in an engaging disposition, i.e., it is pivoted off the path 13. This operating position N is used for an initial insertion and feeding of endless sheet stock either from the rear 10*a* or individual sheets from above into channel 11. The brake brakes the inserted sheets when fed from above.

Additional features and functions of the transport device are the following:

As soon as an individual sheet enters paths 13, a sensor response to the front edge which in the usual fashion causes through in an electronic control the platen 1 to rotate particularly in the direction 8*a* which is counterclockwise in the drawing. The sheet stock along path 13 now passes through the gap between the rolls 5 and the platen 1, is engaged by the guide structure 7 under the frame 9 and passes between the platen 1 and the rolls 8, until a sensor signals the arrival of the sheet front edge whereupon the drive for platen 1 is stopped. Freewheeling structures are provided on the shaft 9*b* and are denoted with reference numeral 8*b*. They permit a rotation of the rolls 8 in clockwise direction. Shaft 9*b* on the other hand, can also rotate in the frame, but with some impediment. The purpose thereof is described in my copending application Ser. No. 517,254, filed July 25, 1983. The brake 12 operates as a brake for the feeding of endless sheet stock along the feed path 13; when pivoted by cam shaft 20, brake 12 operates also as a brake for the feeding of endless sheet stock from above, 10*a* as shown in FIG. 2. The guide sheet 12*b* establishes a break gap 12*a* at the location 1*b* and in cooperation with the platen roll 1. The manually fed paper engages the guide sheet 12*b* causing the individual sheets to be fed in a sliding arrangement.

The invention is not limited to the embodiments described above, but all changes and modifications thereof not constituting departures from the spirit and scope of the invention are intended to be included.

I claim:

1. Apparatus for feeding individual sheets as well as endless sheet stock towards a printing platen drum cooperating with a print head comprising:

a first and a second set of rolls arranged around the periphery of the platen drum, the second set being arranged downstream in the direction of rotation of the platen drum in relation to the first set;

means for mounting and positioning said first and second set of rolls for selective frictional engagement with the platen drum and retraction therefrom;

means for defining a first feed path directing individual sheets towards the periphery of the platen drum upstream from said first set of rolls and including in the vicinity of the platen drum an adjustable brake sheet, one side of which frictionally engages with sheet stock that enters through said first path;

means for defining a second feed path azimuthally separated from the first path in relation to the periphery of the platen drum and including also said brake sheet, said first and second paths being on opposite sides of said brake sheet and merging near said first set of rolls;

and means operatively coupled to said brake sheet and to said positioning means for providing three operating states wherein in a first state said first and second sets of rolls are in frictional engagement with the drum and said brake sheet is positioned to permit sheet feeding through either of said first or second feed paths for single sheet feeding or endless sheet feeding, and in a second state said sets of rolls and said brake sheet are retracted from said drum and said brake sheet obstructs said second feed path for endless sheet feeding, and in a third position the friction rolls are retracted from frictional engagement with the platen drum and said brake sheet obstructs said first feed path and is off the second feed path for sheet insertion.

2. Apparatus as in claim 1 wherein the first feed path has an entrance at a top of the printer, the second feed path has an entrance in the rear of the printer in relation to said printhead and wherein the lower portion of the first feed path is defined by said brake sheet and by said platen drum.

3. Apparatus as in claim 1 said brake sheet being resiliently mounted and being of curved configuration.

4. Apparatus as in claim 1 wherein said second set of rolls are mounted for relatively easy rotation on a shaft, said shaft in turn being mounted for retarded rotation in the frame of the printer.

5. Apparatus as in claim 1 wherein said sets of rolls are mounted on pivot arms.

6. Apparatus as in claim 5 including a manually operable lever drivingly connected to said pivot arms and to said brake and including cam means of particular angular orientation so that in two out of three different adjusting positions of the manually operated lever the lever arms cause the two sets of rolls to be retracted while in the third position the lever arms are pivoted to cause the rolls to frictionally engage the platen drum.

7. Apparatus as in claim 6 wherein said brake sheet is pivoted out of the second feed path in two out of the three adjusting positions for the brake sheet corresponding to the first and third states and it projects into the second feed path in a third one of adjusted positions for the brake sheet corresponding to the second state.

8. Apparatus as in claim 7 including indexing means for locking the manually operable lever into any of the three manually attainable positions.

9. Apparatus for feeding individual sheets as well as endless sheet stock towards a printing platen drum cooperating with a printhead, comprising:

a first and a second set of rolls arranged around the periphery of the platen drum wherein the second set is arranged downstream as far as rotation of the platen drum is concerned in relation to the first set;

means for mounting and positioning said first and second set for frictional engagement with the platen drum and retraction therefrom;

means including a resiliently mounted brake sheet pivotally mounted upstream from said first set of rolls;

a plurality of cam shafts linked for common actuation and respectively operatively connected to the means for mounting and the brake sheet for controlling their disposition vis-a-vis the platen drum and in different combinations of engagement with the drum and retraction thereof;

means for defining a first and a second feed path, the path extending along opposite sides of said brake sheet so that the brake sheet selectively participates in one or the other of the feed paths depending upon the adjustment of the respective cam shafts; and manually operable means connected for actuating said plurality of cam shafts.

10. Apparatus for feeding individual sheets as well as endless sheet stock towards a printing platen drum cooperating with a printhead, comprising:

a first and a second set of rolls arranged around the periphery of the platen drum wherein the second set is arranged downstream as far as rotation of the platen drum is concerned in relation to the first set;

means for mounting and positioning said first and second set for frictional engagement with the platen drum and retraction therefrom means including a resiliently mounted brake sheet pivotally mounted upstream from the first pair of rolls and pivotal into engagement with the platen drum and away therefrom;

means defining first and second feed paths oriented for feeding of sheet stock from different directions but merging in a region between the brake sheet and the first set of rolls, the brake sheet separating the two paths upstream from the point of merging; and means operatively coupled to the means for mounting and to the brake sheet for establishing different combinations of engagement with and retraction from the platen drum of the rolls and the brake sheet.

* * * * *